United States Patent [19]

Pelavin

[11] Patent Number: 4,610,334

[45] Date of Patent: Sep. 9, 1986

[54] LUGGAGE FRAME WITH FLEXIBLE REINFORCEMENT SPRING

[76] Inventor: Joseph Y. Pelavin, 8200-4 Kennedy Blvd. East, North Bergen, N.J. 07047

[21] Appl. No.: 721,961

[22] Filed: Apr. 11, 1985

[51] Int. Cl.[4] ..... A45C 13/04; A45C 13/36; F16F 1/00

[52] U.S. Cl. ..... 190/122; 190/127; 267/144; 267/165

[58] Field of Search ..... 190/103, 107, 115, 122, 190/127, 24, 25; 383/119; 206/315.8; 140/90; 2/257–261; 267/144, 165, 103; 5/247, 255

[56] References Cited

U.S. PATENT DOCUMENTS

| | | | |
|---|---|---|---|
| 1,128,921 | 2/1915 | Wadsworth | 206/315.8 |
| 1,207,104 | 12/1916 | Wallace | 2/259 |
| 2,188,407 | 1/1940 | Horton | 140/90 X |
| 2,439,272 | 4/1948 | Sholtis, Jr. et al. | 140/90 X |
| 2,568,829 | 9/1951 | Scott et al. | 267/144 X |
| 2,822,031 | 2/1958 | Webber | 5/255 X |
| 2,855,985 | 10/1958 | Neely | 267/144 X |
| 3,085,259 | 4/1963 | Sandor | 5/247 |
| 3,730,308 | 5/1973 | Pelavin | 190/127 X |

FOREIGN PATENT DOCUMENTS

| | | | |
|---|---|---|---|
| 813304 | 9/1951 | Fed. Rep. of Germany | 190/103 |

*Primary Examiner*—William Price
*Assistant Examiner*—Sue A. Weaver
*Attorney, Agent, or Firm*—Blum Kaplan Friedman Silberman & Beran

[57] ABSTRACT

A luggage construction wherein a flexible reinforcement spring is utilized. A flat spring having a repeating U-shaped pattern disposed on a wire is provided around the peripheral wall of the luggage to enhance structural integrity and assist in returning the luggage to its original shape after being deformed.

11 Claims, 10 Drawing Figures

FIG. 1
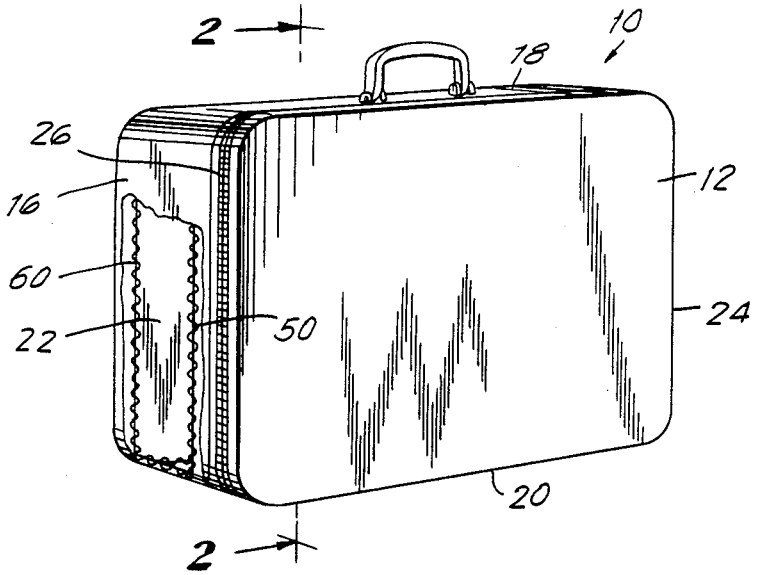
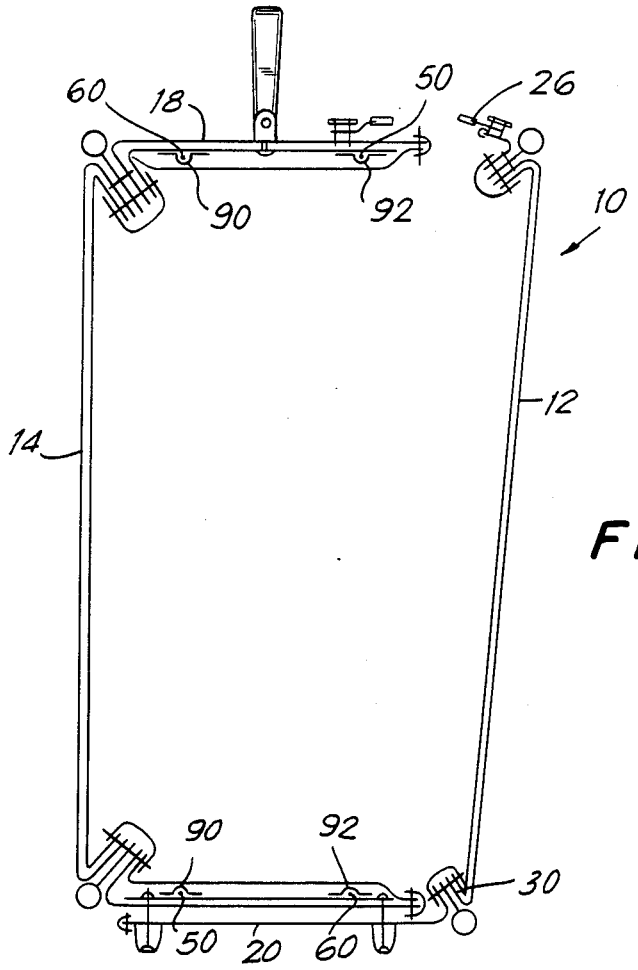
FIG. 2

LUGGAGE FRAME WITH FLEXIBLE REINFORCEMENT SPRING

BACKGROUND OF THE INVENTION

The present invention relates to deformable frames for use in luggage. In particular, the present invention is directed to a deformable luggage construction in which a flexible reinforcement spring having a repeating U-shaped pattern is concealed in the peripheral walls of the luggage to assist the luggage in returning to its original shape after being deformed.

It is known in the luggage industry to fabricate suitcases, luggage and the like in which a frame is used to strengthen and support the side panels of the luggage. The front and rear panels of a suitcase are usually soft, being formed of a heavy cloth, plastic, or other tough, flexible material which is sewn or otherwise fastened to the peripheral walls to form a compartment in which clothing and the like can be stowed for carrying. The front panel of the suitcase is often referred to as a lid which is hinged to the bottom panel of the suitcase through the peripheral wall.

It is the object of luggage of this type that it be soft and lightweight like frameless luggage and yet retain the structural integrity of luggage having a frame. One such effect of eliminating plates or other rigid structural elements in luggage is disclosed in applicant's U.S. Pat. No. 3,730,308, the disclosure of which is incorporated herein by reference as though fully set forth. Although the luggage construction disclosed in applicant's U.S. Pat. No. 3,730,308 avoids the use of rigid plates, the resulting frameless construction is less than completely satisfactory in that the springs disclosed therein are of insufficient strength and structure to provide sufficient structural integrity. Accordingly, a luggage construction having an improved reinforceable flexible spring is desired.

SUMMARY OF THE INVENTION

Generally speaking, in accordance with the present invention, a luggage construction which includes a flexible reinforcement spring is provided. The luggage construction includes a frame having a pair of spaced sidewalls and a peripheral wall joining the pair of spaced sidewalls at their respective edges so as to define the top, bottom and ends of the luggage construction. Portions of the peripheral wall are flexible. A wire extends at least along a portion of the peripheral wall. A flat spring having a repeating Ushaped pattern extends along the wire. The flat spring assists in the restoration of the peripheral wall to its original shape after being deformed and adds to the structural integrity of the construction.

In a preferred embodiment, plates made of a rigid material, such as metal or wood, are disposed on the top and bottom panels of the peripheral wall. At least one wire extends around the peripheral wall. The flat spring includes a plurality of repeating U-shaped and inverted U-shaped elements which form a unitary construction to define the spring. The first and second ends of the spring are both defined by a U-shaped section each having an outer first leg and an inner second leg. The inner second legs of the first and second ends each include a groove. The wire extends along the spring such that the spring is held to and slideably disposed on the wire with the wire extending into the respective grooves. In this manner, the springs are somewhat free to move along the wire to prevent excess deformation of the springs. The wire itself further assists in preventing excessive deformation of the spring.

Accordingly, it is an object of the present invention to provide an improved luggage construction.

Another object of the present invention is to provide an improved luggage frame with a flexible reinforcement spring.

A further object of the present invention is to provide a lightweight, flexible luggage frame in which a sinusoidal-like flat spring in the peripheral wall of the luggage assists the luggage in returning to its original shape after being deformed and enhances the structural integrity of the luggage.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of a luggage construction, partially cut away, constructed in accordance with a preferred embodiment of the present invention.

FIG. 2 is an enlarged schematic sectional view taken along line 2—2 of FIG. 1;

DESCRIPTION OF THE PREFERRED EMBODIMENTS

Figure 3:
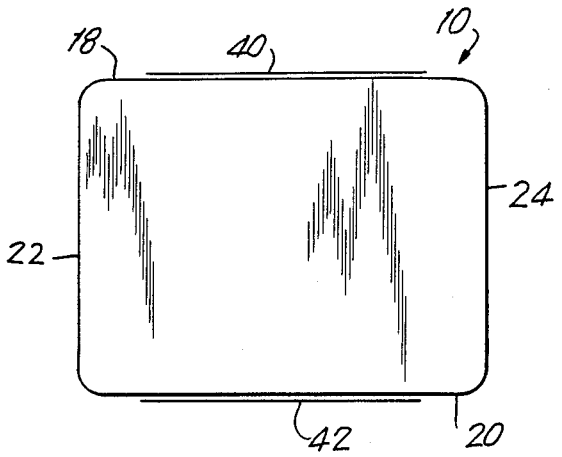
FIG. 3 is a schematic front elevational view of a luggage frame showing the position of the top and bottom plates.

Reference is first made to FIGS. 1 and 2 which depict a luggage construction, generally indicated at 10, in the form of a suitcase constructed in accordance with a preferred embodiment of the present invention. Luggage construction 10 includes a pair of opposed spaced side panels 12 and 14 which respectively define the front panel 12 and rear panel 14 of the suitcase. A peripheral wall 16 extends around the suitcase intermediate front panel 12 and rear panel 14 which defines the top 18, bottom 20, and ends 22 and 24 of luggage construction 10.

Top side panel 12 is secured on the two sides and top of the suitcase to peripheral wall 16 by means of a zipper 26 which permits top side panel 12 to be opened to provide a means of access to the suitcase. A fixed coupling 30 between top panel 12 and bottom 20 of peripheral wall 16 defines a hinge for the pivotable displacement of top panel 12 for the opening and closing of the luggage construction.

Referring now to FIG. 3 it is seen that luggage construction 10 includes a rigid plate 40 disposed on top 18 of the suitcase and a rigid plate 42 disposed on bottom 20 of the suitcase. Plates 40 and 42 cause top 18 and bottom 20 to be substantially non-deformable. However, no such plates are provided on sides 22 and 24 of luggage construction 10 thereby permitting these sides to be deformable under a given load.

It is of course extremely desirable that where a piece of lightweight luggage such as luggage construction 10 is deformable under stresses during normal use, such suitcase should return to its original configuration upon removal of the stress. Otherwise, permanent deformation ruins the appearance, durability and structural integrity of the luggage.

In accordance with the present invention, a flat spring with a repeating sinusoidal-like or U-shaped pattern is provided in the peripheral wall 16 of luggage construction 10. This flexible reinforcement spring substantially assists the luggage when deformed in being returned to its original shape after such deformation. The flat spring also enhances the structural integrity of the suitcase itself. As seen in FIGS. 1 and 2, spring systems 50 and 60 extend around peripheral wall 16 of luggage construction 10. In the embodiment depicted in FIGS. 1 and 2, two spring systems 50 and 60 which are spaced apart, as depicted, are utilized.

Figure 4:
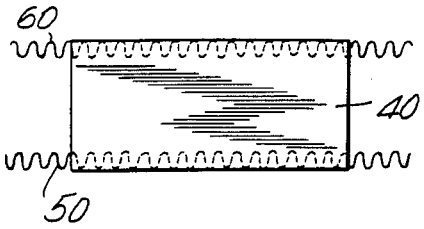
FIG. 4 is a top plan view of the plate shown in FIG. 3 which depicts two flexible reinforcement springs extending thereover.

Referring now to FIG. 4, it is seen that spring systems 50 and 60 extend over plate 40 on top 18 of the luggage. In a preferred embodiment, spring systems 50 and 60 are welded such as by tack welding to plate 40 to prevent displacement of spring systems 50 and 60 with respect to plate 40. It is noted that although plate 40 is preferably made of metal, it can also be made of wood, or any other suitable rigid material.

Figure 5:
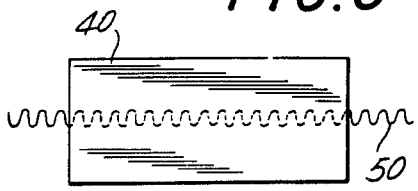
FIG. 5 is a top plan view similar to FIG. 4 but showing a single flexible reinforcement spring extending over the plate.

Two spring systems 50 and 60 are preferably utilized when peripheral wall 16 is wide. Where peripheral wall 16 is not as wide, a single spring system 50 as depicted in FIG. 5 can be utilized.

Figure 6A:
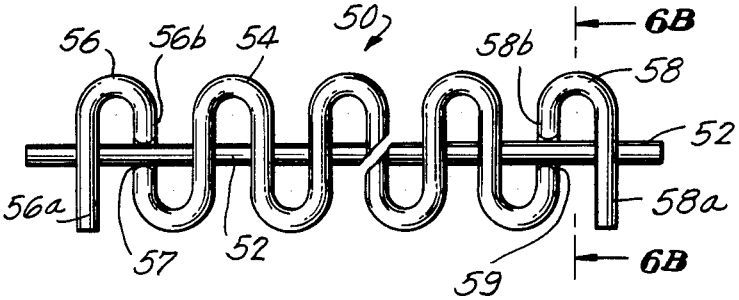
FIG. 6A is a front elevational view of a flexible reinforcement spring shown coupled to a wire and constructed in accordance with the present invention.
Figure 6B:
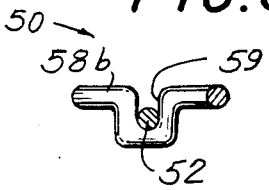
FIG. 6B is a partial sectional view taken along line 6B—6B of FIG. 6A.

Referring now to FIGS. 6A and 6B, the construction of spring system 50 will be described. Spring system 50 includes a reinforcing wire 52 which supports a sinusoidal-like flat spring 54 having a repeating U-shaped pattern. Flat spring 54 is preferably made of a tempered wire and appears as in FIG. 6A as a plurality of coupled U-shaped and inverted U-shaped sections. Flat spring 54 includes a first end 56 and a second end 58. First end 56 includes a first leg **56*a* and a second leg 56*b*. Similarly, second end 58 includes a first end 58*a* and a second end 58*b***.

In order that flat spring 54 be slideably disposed on reinforcing wire 52, reinforcing wire 52 passes intermediate first leg **56*a* and second leg 56*b* of first end 56 and intermediate first leg 58*a* and second leg 58*b* of second end 58. In order to further accommodate the coupling of reinforcing wire 52 to flat spring 54, grooves 57 and 59 are provided, respectively, on second leg 56*b* of first end 56 and second leg 58*b* of second end 58 of flat spring 54. This is best depicted in FIG. 6B. Thus, as depicted in FIG. 6A, second leg 56*b* of first end 56 and second leg 58*b* of second end 58 lie on a first side of wire 52 whereas the remaining portions of flat spring 54 lie on the opposite side of wire 52. In this manner, although flat spring 54 is held on wire 52, it is sufficiently slideable along reinforcing wire 52 such that should an excess load be placed on suitcase 10, excess stress on flat spring 54 will not cause flat spring 54 to be permanently deformed. Moreover, reinforcing wire 52 itself also assists in the prevention of permanent deformation of flat spring 54** due to its tensile strength.

Figure 7A:
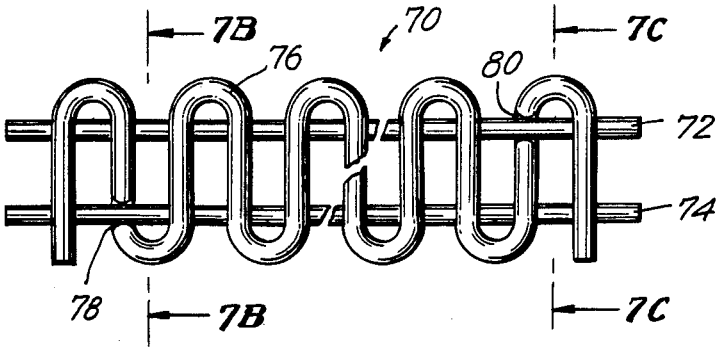
FIG. 7A is a view similar to FIG. 6A but showing a flexible reinforcement spring suported on two wires.
Figure 7B:
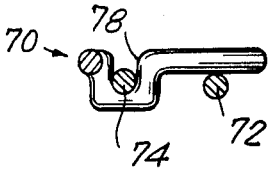
FIG. 7B is a partial sectional view taken along line 7B—7B of FIG. 7A.
Figure 7C:
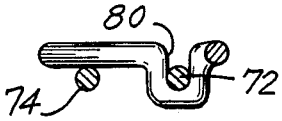
FIG. 7C is a partial sectional view taken along line 7C—7C of FIG. 7A.

FIGS. 7A through 7C depict a second embodiment of a flat spring system 70 wherein two reinforcing wires 72 and 74 are utilized. In the embodiment depicted in 7A, flat spring 76 is wider than flat spring 54 depicted in FIG. 6A. The two wires 72 and 74 are preferable with such a wide flat spring to enhance the structural integrity of the spring system. As in FIG. 6A, the construction depicted in FIG. 7A includes a flat spring 76 having respective grooves 78 and 80 at opposite ends thereof to permit flat spring 76 to ride along reinforcing wires 72 and 74.

Referring again to FIG. 2, it is noted that spring systems 50 and 60 are shown disposed in a channel defined by lengths of material 90 and 92 which extend around the peripheral wall 16. By providing the channels defined by materials 90 and 92, the spring systems 50 and 60 are protected, and suitcase 10 is protected from any damage which could otherwise be caused by spring systems 50 and 60.

The present invention provides an improved luggage frame construction for a lightweight flexible luggage case or suitcase. The flexible reinforcement spring system which includes a reinforcing wire and flat spring disposed thereon provides an improved system for returning such flexible luggage case to its original shape after being deformed by exposure to excess stresses.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A luggage construction comprising a pair of spaced sidewalls, a peripheral wall joining said pair of spaced sidewalls at their respective edges and defining the top, bottom and ends of said luggage construction, portions of said peripheral wall being flexible, wire means extending laterally in a direction essentially parallel to the edges of said spaced sidewalls at least along a flexible portion of said peripheral wall, a flat spring having a repeating U-shaped pattern extending along said wire means in said lateral direction, and coupling means for slidably coupling said flat spring to said wire means, said flat spring assisting in the restoration of said peripheral wall to its original shape after being deformed.

2. The luggage construction as claimed in claim 1, wherein said coupling means includes first and second ends on said flat spring, said first and second ends being slideably coupled to said wire means.

3. The luggage construction as claimed in claim 2, wherein said first and second ends of said flat spring each include at least one groove, said wire means extending into said grooves to hold said flat spring slidably on said wire means.

4. The luggage construction as claimed in claim 3, wherein said wire means includes at least a first tempered wire.

5. The luggage construction as claimed in claim 3, wherein said wire means includes first and second wires, said flat spring being slideably supported by said first and second wires such that said first and second wires are substantially parallel.

6. The luggage construction as claimed in claim 1, further comprising a first plate supported on the peripheral wall defining the top of said luggage construction and a second plate supported on the peripheral wall defining the bottom of said luggage construction, said wire means and said flat spring extending across said first and second plates.

7. The luggage construction as claimed in claim 6, wherein said flat spring is coupled to said first plate.

8. The luggage construction as claimed in claim 7, wherein said top and bottom plates are made of metal.

9. The luggage construction as claimed in claim 7, wherein said top and bottom plates are made of wood.

10. The luggage construction as claimed in claim 7, wherein said wire means includes first and second wires which extend in parallel relation around said peripheral wall, said flat spring being supported on said first wire, and further comprising a second flat spring having a repeating U-shaped pattern supported on said second wire.

11. A spring device for use in a support frame comprising at least one wire supported on said support frame, and a flat spring having first and second ends having a repeating U-shaped pattern extending along said wire, said first and second ends of said flat spring each including at least one groove, said wire extending into said grooves to hold said flat spring slidably on said wire means.

* * * * *